US008979468B2

(12) United States Patent
Oyama et al.

(10) Patent No.: US 8,979,468 B2
(45) Date of Patent: Mar. 17, 2015

(54) LOADING WORK APPARATUS WITH ATTACHMENT TOOLS

(71) Applicant: Kubota Corporation, Osaka-shi (JP)

(72) Inventors: Kosuke Oyama, Sakai (JP); Kenzo Ushiro, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 13/775,730

(22) Filed: Feb. 25, 2013

(65) Prior Publication Data

US 2014/0064899 A1 Mar. 6, 2014

(30) Foreign Application Priority Data

Jun. 26, 2012 (JP) ..... 2012-143124

(51) Int. Cl.
*E02F 3/00* (2006.01)
*E02F 3/36* (2006.01)
*E02F 3/627* (2006.01)

(52) U.S. Cl.
CPC ..... *E02F 3/3663* (2013.01); *E02F 3/3627* (2013.01); *E02F 3/364* (2013.01); *E02F 3/3668* (2013.01); *E02F 3/3672* (2013.01); *E02F 3/627* (2013.01)
USPC ..... 414/723; 403/322.4

(58) Field of Classification Search
CPC ..... E02F 3/3663; E02F 3/3627; E02F 3/364; E02F 3/3672; E02F 3/3668
USPC ..... 414/723; 403/322.4
See application file for complete search history.

(56) References Cited

U.S. PATENT DOCUMENTS

| | | | | |
|---|---|---|---|---|
| 3,732,996 | A * | 5/1973 | Bauer | 414/815 |
| 4,812,103 | A * | 3/1989 | Cochran et al. | 414/723 |
| 5,562,397 | A | 10/1996 | Albright | |
| 5,836,734 | A * | 11/1998 | Doering | 414/723 |
| 6,238,130 | B1 * | 5/2001 | Youngers | 414/723 |
| 6,619,906 | B2 * | 9/2003 | Dick | 414/723 |
| 6,939,099 | B1 * | 9/2005 | Stokkeland | 414/723 |
| 7,073,972 | B1 * | 7/2006 | Schumacher | 403/382 |
| 7,513,732 | B1 * | 4/2009 | Callens | 414/723 |
| 8,024,875 | B2 * | 9/2011 | Wetzel et al. | 37/468 |
| 2003/0095857 | A1 * | 5/2003 | Degelman | 414/685 |
| 2006/0070759 | A1 * | 4/2006 | Nesseth | 172/817 |

FOREIGN PATENT DOCUMENTS

JP 201199239 A 5/2011

* cited by examiner

*Primary Examiner* — Gerald McClain
(74) *Attorney, Agent, or Firm* — The Webb Law Firm

(57) ABSTRACT

A loading work apparatus includes booms, attachment tools, an implement tool removably attached to the attachment tools, and implement tool cylinders. The implement tool includes an engaged member on a back surface thereof. The attachment tools include an attachment unit having an engaging member engaged with the engaged member, coupling members supporting the transverse shaft, and lock members locking/unlocking engagement between the engaging member and engaged member. Each coupling member includes brackets on lateral opposite sides of the lock member. The transverse shaft is supported at opposite ends thereof by lower portions of the right and left brackets. The support shaft is supported at opposite ends thereof by intermediate portions of the right and left brackets. The transverse shaft and the support shaft bridge across the lock member.

3 Claims, 6 Drawing Sheets

LOADING WORK APPARATUS WITH ATTACHMENT TOOLS

BACKGROUND OF THE INVENTION

1. Filed of Invention

The present invention relates to a loading work apparatus removably attaching an implement tool thereto.

2. Description of Related Art

The loading work apparatus mounted on a tractor, a wheel loader, a skid-steer loader and the like includes an implement tool removably attached to distal ends of booms for easy exchange for another implement tool. As disclosed in JP 2011-099239 A and U.S. Pat. No. 5,562,397, the loading work apparatus of this type includes a pair of right and left booms, attachment tools each pivotally supported at a distal end of the boom associated therewith by a transverse shaft, an implement tool removably attached to the attachment tools, and a pair of right and left implement tool cylinders each connected to the attachment tools associated therewith by support shaft for pivoting the implement tool about the transverse shaft.

The implement tool has an engaged member provided in a back surface thereof. The attachment tools include an attachment unit provided along and close to the back surface of the implement tool and having an engaging member engaged with the engaged member, a pair of right and left of coupling members each provided in a back surface of the attachment unit to support the transverse shaft, and a pair of right and left of lock members supported by the attachment unit for locking and unlocking engagement between the engaging member and engaged member.

The attachment tool has a quick-hitching structure for removably mounting various types of implement tools (attachments), with the transverse shaft and support shaft being arranged in positions laterally displaced from each lock member in the back surface of each attachment tool.

In the above-noted conventional apparatus, the right and left lock members of the attachment tools are provided at fixed positions for common attachment of a variety of implement tools, and further the transverse shaft and support shaft of each coupling member are arranged laterally outward of each of the lock members. As a result, the conventional apparatus is not easily applicable when the interval defined between the right and left booms is the same as or smaller than the interval defined between the right and left lock members.

An object of the present invention is to provide a loading work apparatus for solving the above-noted problem.

SUMMARY OF THE INVENTION

The above object is fulfilled by one aspect of the present invention as under:

A loading work apparatus comprising:

a pair of right and left booms;

attachment tools, each of the attachment tools being pivotally supported at a distal end of the boom associated therewith by a transverse shaft;

an implement tool removably attached to the attachment tools; and a pair of right and left implement tool cylinders, each of the implement tool cylinders being connected to the attachment tool associated therewith by a support shaft for rotatting the implement tool about the transverse shaft;

wherein the implement tool includes an engaged member on a back surface thereof;

wherein the attachment tools include:

an attachment unit provided along and close to the back surface of the implement tool, the attachment unit having an engaging member engageable with the engaged member;

a pair of right and left coupling members, each of the coupling members being provided on a back surface of the attachment unit for supporting the transverse shaft; and a pair of right and left of lock members supported by the attachment unit for locking and unlocking engagement between the engaging member and engaged member; and wherein each of the coupling members includes a pair of right and left brackets standing upright from the back surface of the attachment unit on lateral opposite sides of the lock member associated therewith;

the transverse shaft is supported at opposite ends thereof on respective lower portions of the right and left brackets;

the support shaft is supported at opposite ends thereof on respective intermediate portions of the right and left brackets; and wherein the transverse shaft and the support shaft are arranged to bridge across each of the lock members.

With the above-noted arrangement, since the transverse shaft at the distal end of each boom and the support shaft at a distal end of each implement tool cylinder are arranged to bridge across each of the lock members in the back surface of the attachment tools, the apparatus is easily applicable when the interval defined between the right and left booms is the same as or smaller than the interval defined between the right and left lock members.

More particularly, each of the coupling members includes right and left upright brackets on lateral opposite sides of each of the lock members on the back surface of the attachment unit, the transverse shaft is supported at opposite ends thereof by lower portions of the right and left brackets, the support shaft is supported at opposite ends thereof by intermediate portions of the right and left brackets, and the transverse shaft and the support shaft are arranged to bridge across each of the lock members. Thus, even if the interval defined between the right and left booms is the same as or smaller than the interval defined between the right and left lock members, the attachment tools can be attached to removably connect the implement tool thereto.

According to a preferred embodiment:

the engaged member includes right and left upper engaged portions and right and left lower engaged portions provided on lateral opposite sides of the back surface of the implement tool; and the attachment unit includes:

right and left upper engaging portions and right and left lower engaging portions engageable with the right and left upper engaged portions and right and left lower engaged portions of the implement tool, respectively;

a pair of right and left backing plates, each of the backing plates having the right and left brackets and the lock member; and a connecting rod for connecting the right and left backing plates to each other.

With the above-noted arrangement, the attachment unit has right and left backing plates including the upper and lower engaging portions, the right and left brackets and the lock members, and a connecting rod for connecting the right and left backing plates to each other. Thus, such an arrangement makes an inexpensive construction with the right and left backing plates being connected to each other by the connecting rod.

According to another preferred embodiment:

each the lock members includes:

a lock pin vertically movably supported by the attachment tool associated therewith and projecting downward therefrom to be engaged with the engaged member associated therewith of the implement tool; and a manual lever pivotally supported by the attachment tool associated therewith for pushing and pulling the lock pin through a link; and wherein the lock pin is positioned laterally outward of each of the pair of right and left booms.

With the above-noted arrangement, since the lock pin is positioned laterally outward of each of the pair of right and left booms, the present invention is applicable even if the interval defined between the right and left booms and the interval defined between the right and left implement tool cylinders are smaller than the interval defined between the right and left lock members.

Other features, advantages and effects of the present invention will be apparent from the following descriptions with reference to the accompanying drawings.

DETAILED DESCRIPTION OF THE INVENTION

Embodiments of the present invention will be described hereinafter with reference to the accompanying drawings.

Figure 1:
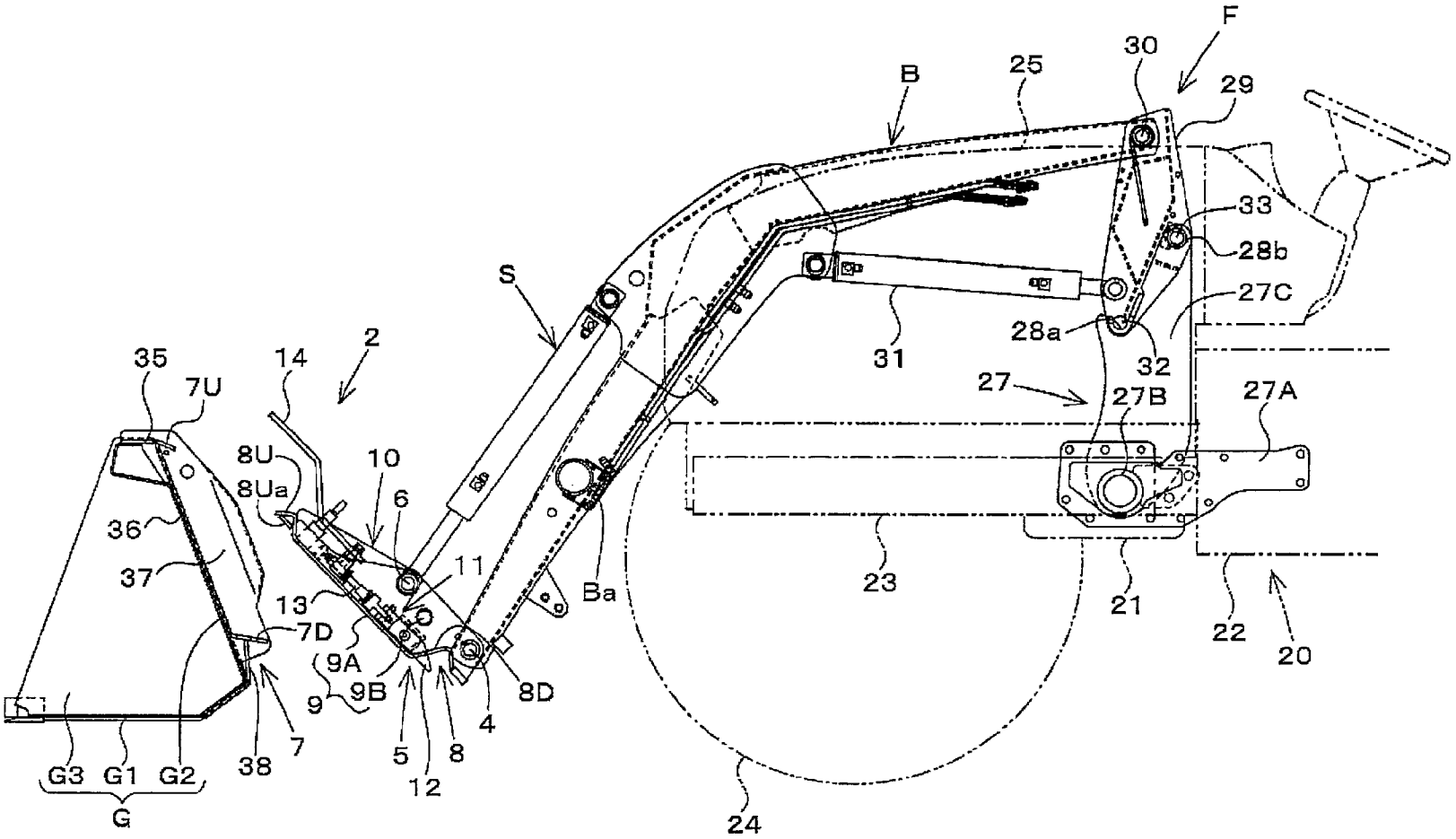
FIG. 1 is a side view of a loading work apparatus according to one embodiment of the present invention with an implement tool being removed.
Figure 2:
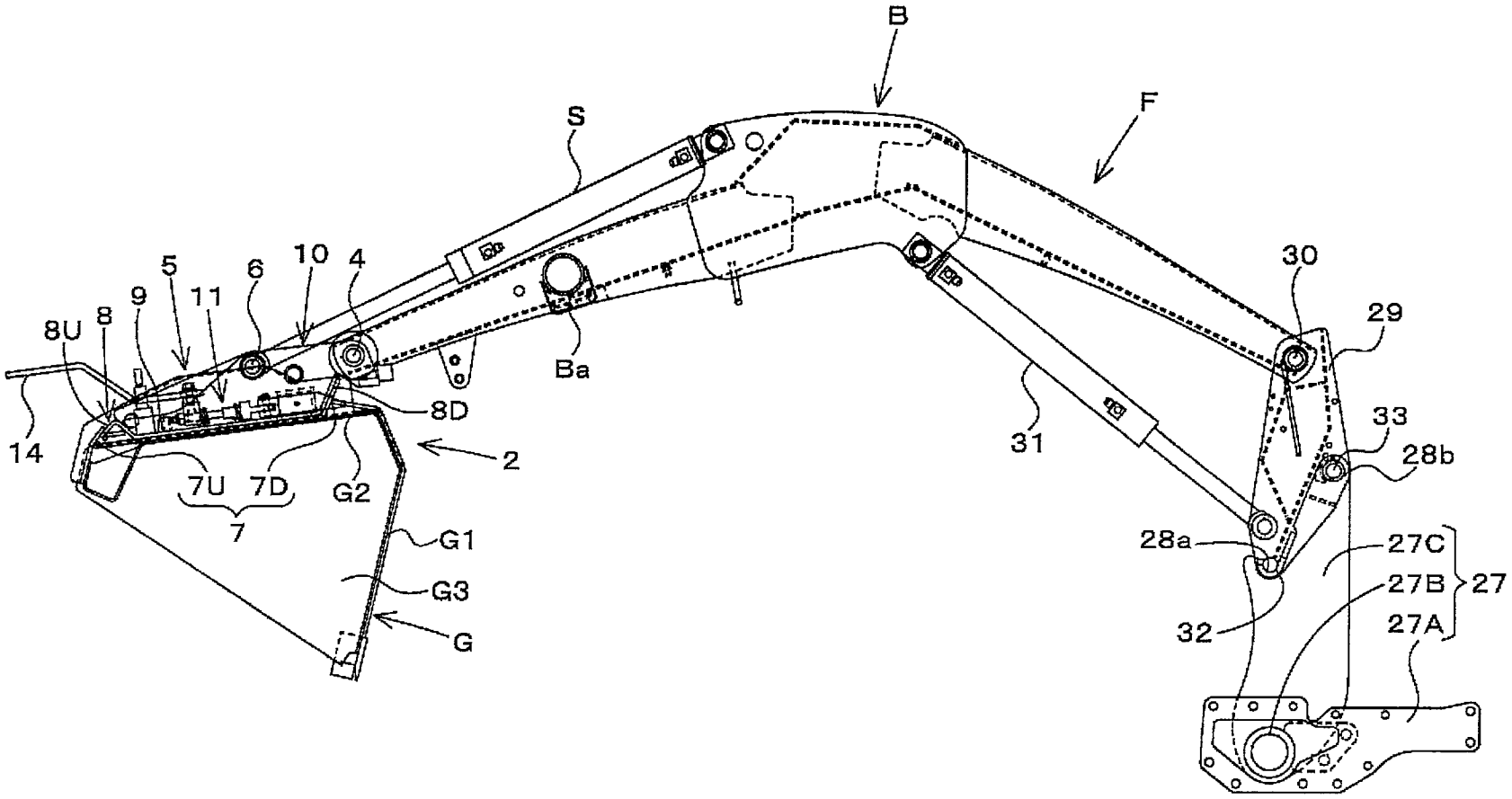
FIG. 2 is a side view of the loading work apparatus with the implement tool being attached.

FIG. 1 shows a front loader attached to a traveling vehicle body 20, as an example of a loading work apparatus F. A tractor acting as the traveling vehicle body 20 includes: a transmission case 22 connected to a rear portion of an engine 21; front frames 23 projecting forward from the engine 21; a front wheel 24 suspended from the front frame 23 associated therewith; a hood 25 covering the engine 21; and front loader attachment frames 27 mounted on lateral opposite sides of the engine 21 and transmission case 22.

Each of the front loader attachment frames 27 includes: an attachment plate 27A extending from the engine 21 to the transmission case 22 and bolted thereto; a cylindrical attachment tube 27B secured to the attachment plate 27A and extending laterally outward therefrom; and a supporting plate 27C extending upright from an outer end portion of the attachment tube 27B. The supporting plate 27C has a receiving recess 28*a* formed in a vertical intermediate portion thereof and an attachment-pin hole 28*b* formed in an upper portion thereof.

The front loader F includes: right and left masts 29; right and left booms B, each having a proximal portion thereof pivotally supported at an upper portion of the mast 29 associated therewith through a pivotal shaft 30; boom cylinders 31 each connected between a longitudinal intermediate portion of the boom B and a lower portion of the mast 29 associated therewith; attachment tools 5 each pivotally supported at a distal end of the boom B associated therewith through a transverse shaft 4; an implement tool (bucket) G removably attached to the attachment tools 5; and implement tool cylinders (bucket cylinders) S each provided between a longitudinal intermediate portion of the boom B and the attachment tool 5 associated therewith.

Each of the right and left masts 29 is removably attached to the attachment frame 27 associated therewith by engagement between the receiving recess 28*a* of the supporting plate 27C and a pin-shaped engaging portion 32 formed in a lower end of the mast 29, and by insertion of an attachment pin 33 into a connecting-pin hole formed in a vertical intermediate portion of the mast and the attachment-pin hole 28*b* of the supporting plate 27C.

With reference to FIGS. 1 to 4, each boom B has an inverted V-shape. The pair of right and left booms B are connected to each other through an intermediate coupling member Ba. The attachment tool 5 has a lower portion thereof pivotally supported at the distal end of the boom B through the transverse shaft 4, and an intermediate portion thereof connected to a distal end of a cylinder rod of the implement tool cylinder S through a support shaft 6.

The implement tool G is removably attached to the attachment tools 5, the implement tool G and attachment tools 5 forming an implement tool attachment device 2 together. The right/left implement tool cylinder S is opposed to a forward and upward portion of the right/left boom B, and extended and contracted to pivotally rotate the right/left attachment tool 5 about the transverse shaft 4 associated therewith. The cylinders S are contracted from a position where the implement tool G contacts the ground to allow the implement tool G to perform a scooping operation and extended to allow the implement tool G to perform a dumping operation to a position shown in FIG. 2.

Figure 5:
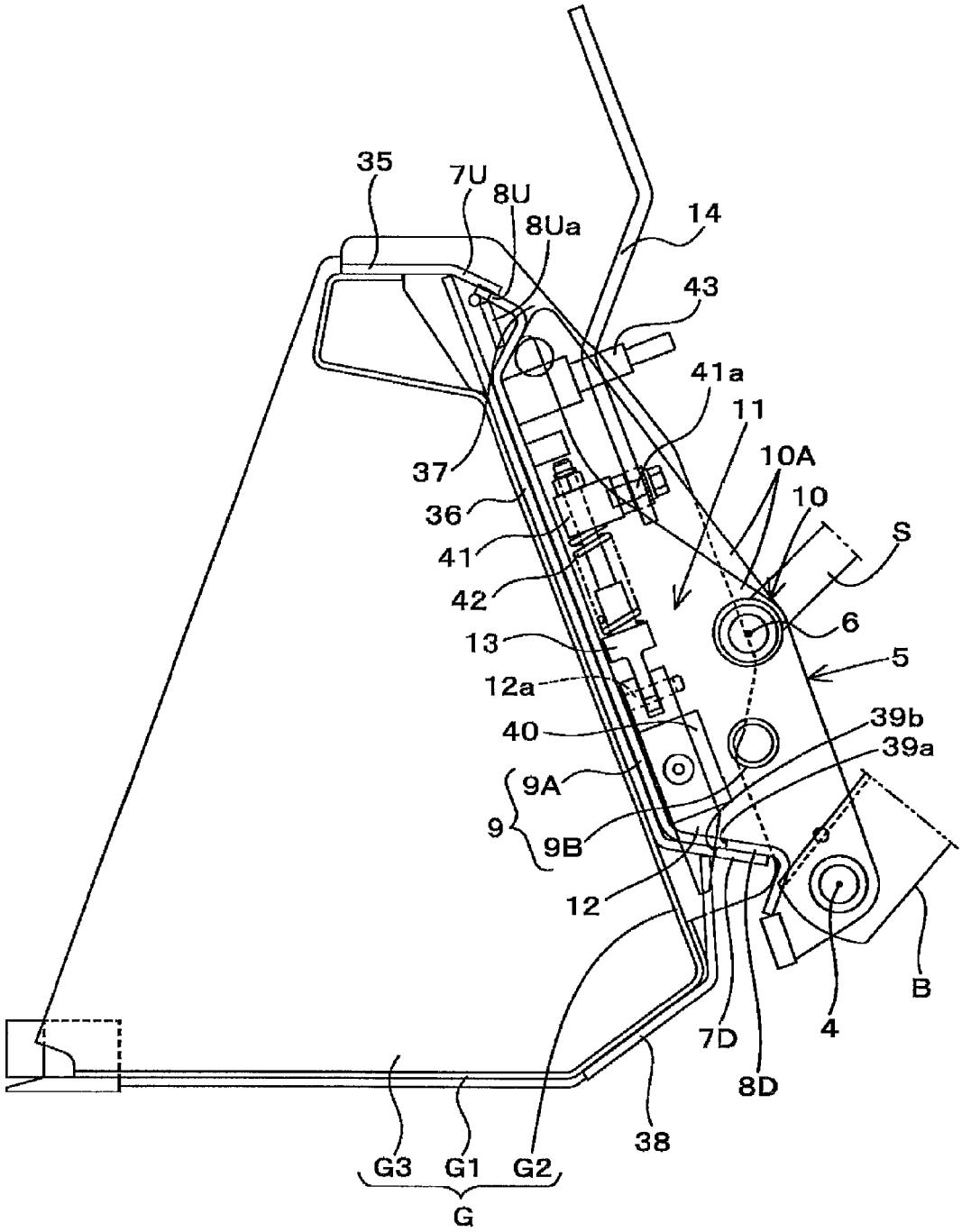
FIG. 5 is a side view in vertical section of the attachment tool with the implement tool being attached.

It should be noted that the terms "vertical direction" and "longitudinal direction" are used in the embodiment with reference to FIGS. 1 and 5, in which a bottom wall G1 of the bucket G comes into contact with the ground.

With reference to FIGS. 1 to 5, the bucket G is shown as an example of the implement tool G. The bucket G includes: the bottom wall G1, a rear wall G2, and lateral walls G3 provided at lateral opposite ends of the bottom wall and rear wall. A top plate 35 is mounted on the top of the bucket G to extend substantially over an entire width thereof; stiffening plates 36 and guide plates 37 are provided on lateral opposite sides of a back surface of the rear wall G2; and a bottom plate 38 extends from the bottom wall G1 to lower portions of the stiffening plates 36.

The implement tool G includes an engaged member 7 on the back surface of the rear wall G2. The engaged member 7 has right and left upper engaged portions 7U each formed by the top plate 35 projecting rearward and downward from a top portion of the stiffening plate 36, and right and left lower engaged portions 7D each formed by a lower portion of the stiffening plate 36 bending and projecting rearward and downward.

The right and left guide plates 37 are provided laterally outward of the right and left stiffening plates 36 and have rear portions thereof inclined to flare rearward, thereby to guide right and left positions of the attachment tools 5 approaching the guide plates 37 from behind.

The attachment tools 5 include: an attachment unit 9 provided along with and close to the back surface of the implement tool G and having an engaging member 8 engageable with the engaged member 7; a pair of right and left coupling members 10 provided on the back surface of the attachment unit 9 to support the respective transverse shafts 4; and right and left pair of lock members 11 supported by the attachment unit 9 to lock and unlock the engagement between the engaging member 8 and engaged member 7.

The attachment unit 9 may be a single plate with a lateral width thereof extending between the right and left stiffening plates 36. In the illustrated embodiment, however, the attachment unit 9 is formed of a pair of right and left backing plates 9A each having a lateral width thereof corresponding to that of the right/left stiffening plate 36; and a connecting rod 9B interconnecting the right and left backing plates 9A, so that the attachment unit makes lighter than the single plate extending over the entire lateral width.

Each of the backing plates 9A has an upper portion thereof bent into V-shape to form an upper engaging portion 8U coming into and engageable with a bottom surface of the engaged portion 7U, and a lower portion thereof bent in V-shape to form a lower engaging portion 8D placed on and engageable with a top surface of the lower engaged portion 7D. Lock pin holes 39*a*, 39*b* are formed in the lower engaged portion 7D and lower engaging portion 8D, respectively to come into alignment with each other when the lower engaged portion 7D and lower engaging portion 8D are overlapped with each other.

Each of the right and left backing plates 9A has right and left brackets 10A standing upright therefrom for extending the connecting rod 9B therethrough. The right and left brackets 10A form the coupling member 10.

The coupling member 10 includes boss portions formed in respective lower portions of the right and left brackets 10A for supporting opposite ends of the transverse shaft 4. A distal end of the boom B is inserted between the right and left boss portions and fitted on the transverse shaft 4. The coupling member 10 includes further boss portions formed in respective vertical intermediate portions of the right and left brackets 10A for supporting opposite ends of the support shaft 6. A distal end of the cylinder rod of the implement tool cylinder S is inserted between the right and left boss portions and fitted on the support shaft 6.

The right and left boss portions for the transverse shaft 4 and the right and left boss portions for the support shaft 6 are formed of tubular members, respectively. The lateral width of each tubular member is variable to vary a lateral position of the distal end of the boom B or the implement tool cylinder S.

Each of the right and left lock members 11 is disposed between the right and left brackets 10A associated therewith. A lock pin 12 is vertically movably supported by a tubular guide 40 which is fixed to a back surface of the backing plate 9A. A lower portion of a link 13 is connected to an upper portion of the lock pin 12 through a pin 12*a*. A slidable member 41 is provided at an upper portion of the link 13. A spring 42 is fitted on an intermediate portion of the link 13. One end of a manual lever 14 is connected to a pin hole 41*a* of the slidable member 41.

The manual lever 14 is pivotally supported by a support pin 43 which is fixed to the backing plate 9A. The right and left manual levers 14 are arranged in proper positions that enable one operator to oscillate both the levers 14 simultaneously.

Figure 3:
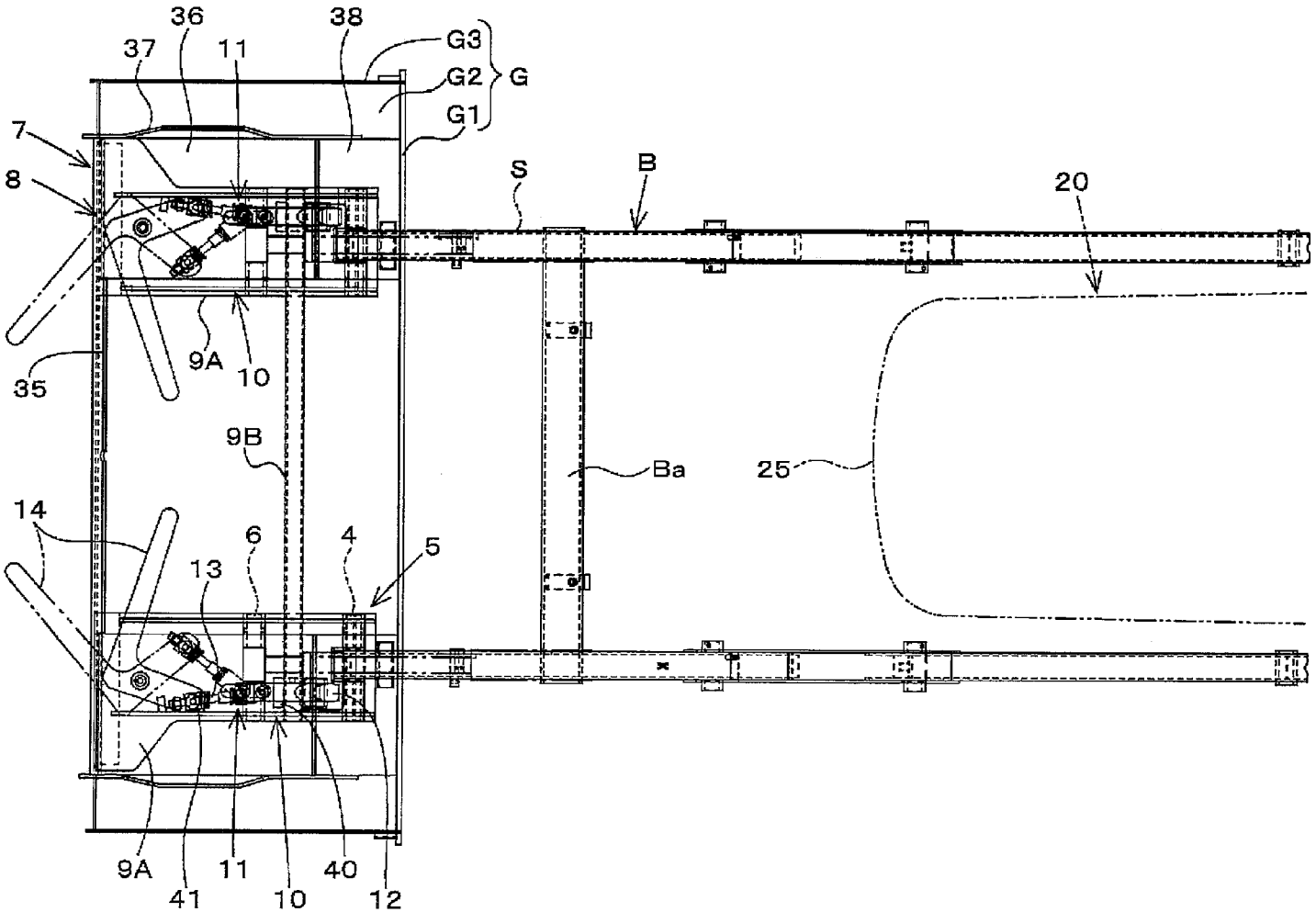
FIG. 3 is a top plan view of the loading work apparatus shown in FIG. 2.
Figure 4:
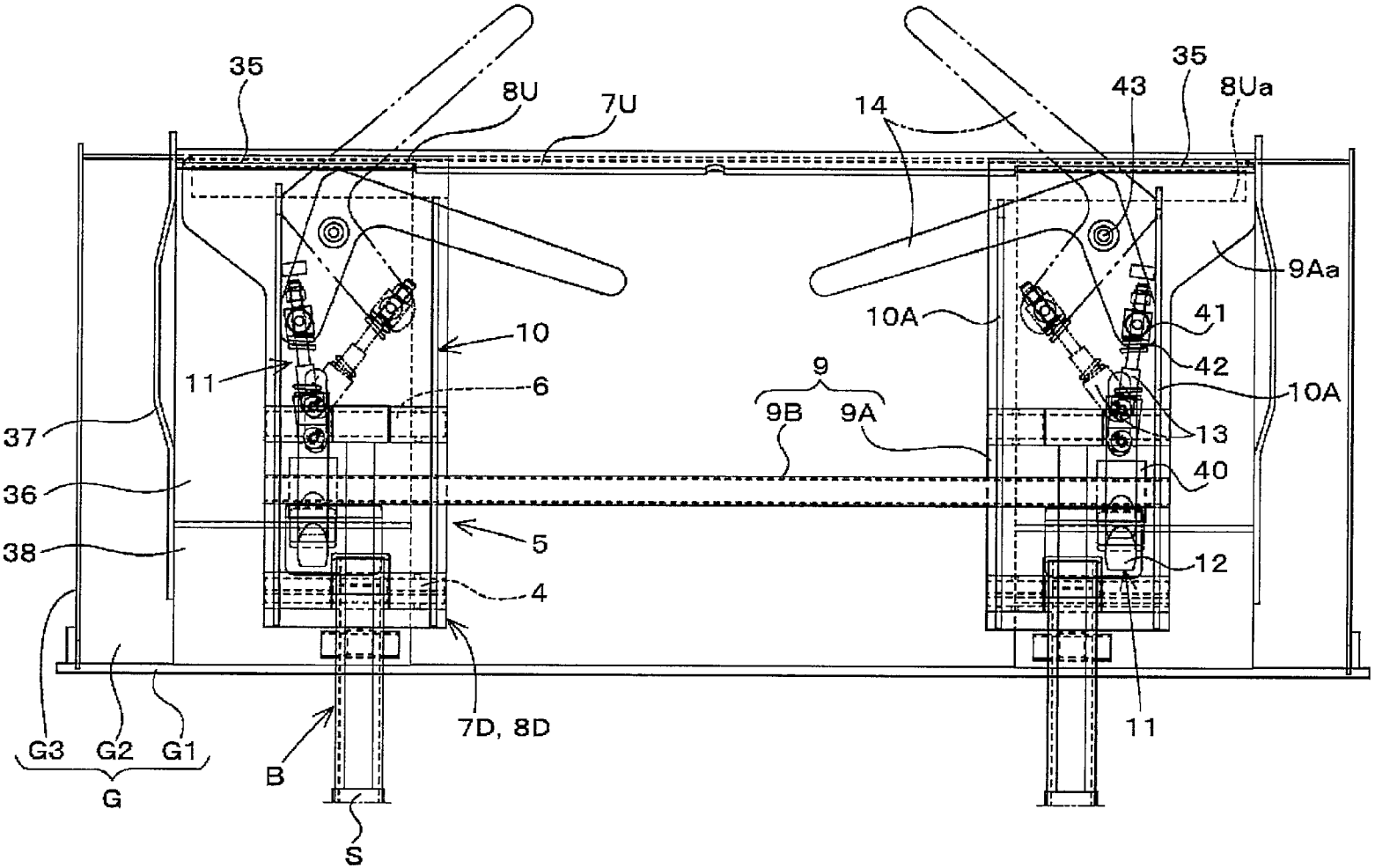
FIG. 4 is an enlarged rear view of an attachment tool.
Figure 6:
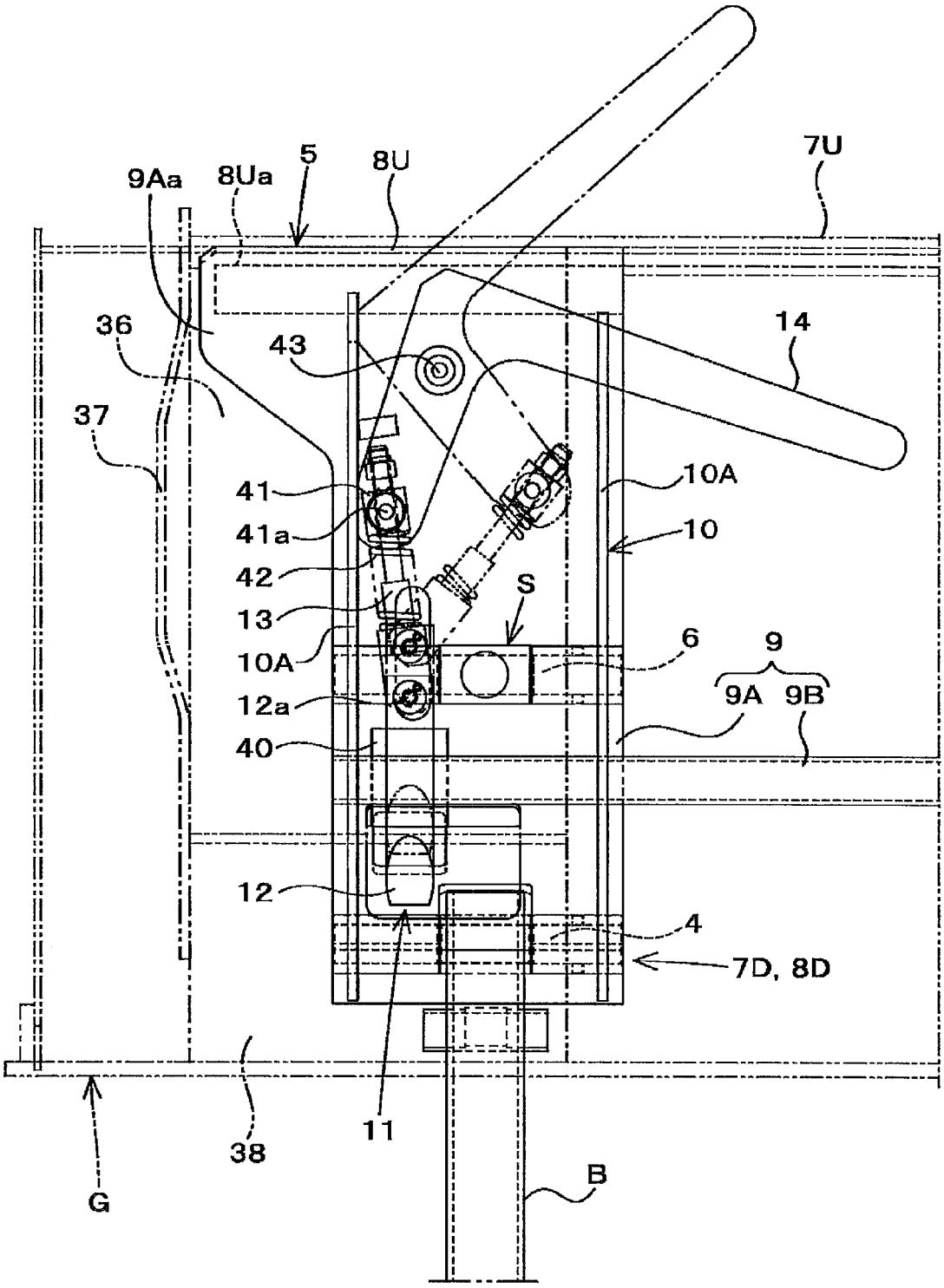
FIG. 6 is a rear view of the attachment tool.

With reference to FIGS. 3, 4 and 6, an unlocking position where a distal end of the manual lever 14 acting as a grip projects from the attachment tool 9 is shown in two-dot chain line, while a locking position where the grip enters the attachment tool 9 is shown in solid line.

When the manual lever 14 is oscillated from the unlocking position, a proximal end of the manual lever 14 compresses the spring 42 through the slidable member 41 to push the link 13 and lower the lock pin 12. An extreme end of the lock pin 12 is projected from the tubular guide 40 and the lock pin hole 39*a* of the lower engaging portion 8D and inserted into the lock pin hole 39*b* of the lower engaging portion 7D, thereby to prevent the lower engaged portion 7D from disengaging from the lower engaging portion 8D, so that the attachment of the implement tool G is locked.

When the manual lever 14 is brought to the locking position, the slidable member 41 passes a center line extending between the pin 12*a* and the support pin 43 to come into contact with one of the brackets 10A and is maintained in position by an elastic force of the spring 42.

The manual lever 14 is bent so that a portion thereof between the support shaft 43 and the grip extends remote away from the backing plate 9A. One of the brackets 10A which is overlapped with the manual lever 14 in the locking position has a smaller height than the other bracket 10A which is brought into contact with an end of the manual lever 14 connected to the slidable member 41.

An interval defined between the right and left brackets 10A is determined so that the slidable member 41 comes into contact with one of the brackets 10A when one end of the manual lever 14 between the right and left brackets 10A is oscillated to establish the locking position. Then, the lock pin 12 is displaced right or left from a central position of the interval defined between the right and left brackets 10A, and comes closer to the backing plate 9A than to the transverse shaft 4 and the support shaft 6.

The transverse shaft 4 is positioned below the lock pin 12 and the support shaft 6 is positioned above the lock pin 12. The transverse shaft 4 and the support shaft 6 are overlapped with the lock pin 12 in the lateral direction to pass the back surface side of the lock member 11. The transverse shaft 4 is positioned downward of the lower engaging portion 8D and remote from the implement tool G.

Thus, the transverse shaft 4 and the support shaft 6 are arranged to bridge across the lock member 11, and the lock pin 12 is positioned laterally outward of the boom B and the implement tool cylinder S disposed in the central region of the interval defined between the right and left brackets 10A.

Each backing plate 9A has a projection 9Aa in an upper portion thereof projecting to a lateral side. The right and left projections 9Aa is configured to come into contact with the right and left guide plates 37, respectively for guiding the right and left positions of the attachment unit 9, when the attachment unit 9 is engaged with the back surface of the implement tool G.

While those projections 9A project laterally outward from the attachment unit 9, the projections 9A may project laterally inward from the projections 9A instead. Then, the projections 9A may be applied and attached to the booms B and the implement cylinders S each arranged at enlarged intervals, while the right and left brackets 10A, transverse shafts 4, support shafts 6 and locking members 11 remains to be used as they are.

With the implement tool G contacting the ground as shown in FIG. 1, the attaching operation using the implement tool attachment device 2 is performed by lowering the booms B to move the attachment tools 5 toward the back surface of the implement tool G, engaging the right/left upper engaging portions 8U with the right/left upper engaged portions 7U from below, and raising the upper engaging portions 8U to lift the implement tool G. As a result, the lower engaged portions 7D of the implement tool G approach and engage with the lower engaging portions 8D, respectively.

With the right and left upper engaged portions 7U and the right and left lower engaged portions 7D being engaged with the upper engaging portions 8U and the lower engaging portions 8D, respectively, when the right and left manual levers 14 are oscillated from the position shown in two-dot chain line to the position shown in solid line in FIG. 3, the extreme ends of the lock pins 12 project from the lock pin holes 39*a* of the lower engaging portions 8D, and are inserted into and come into engagement with the lock pin holes 39*b* of the lower engaged portions 7D, thereby coupling and locking the implement tool G to the attachment tools 5.

In forming the implement tool attachment device 2, the positions of the upper engaged portions 7U, lower engaged portions 7D, guide plates 37 and the lock pin holes 39*b* for the implement tool G are predetermined or fixed regardless of the type of the implement tool G to be coupled. Thus, the positions of the upper engaging portions 8U, lower engaged portions 8D and lock pin holes 39*a* of the attachment tools 5 are also predetermined or fixed. Inevitably, the positions of the lock members 11 and the position of one of the brackets 10A with which the slidable member 41 of each manually-operable lock member 11 comes into contact are also predetermined or fixed.

The components of the implement tool attachment device 2 other than the one of the brackets 10A contacting the slidable member 41 of the manually-operable locking member 11 may be designed so as to reverse the lateral positions thereof. For example, the right/left backing plate 9A may have its projection 9Aa projecting laterally inward, and the other bracket 10A not contacting the slidable member 41 may be arranged laterally outward of the bracket 10A contacting the slidable member 41, so that the transverse shafts 4 and support shafts 6 may be supported by another brackets provided separately from the right and left brackets 10A.

As described in the above embodiment, however, if the lock member 11 is disposed between the right and left brackets 10A, and if the transverse shaft 4 and support shaft 6 are disposed to bridge across the lock member 11, then, such another brackets can be dispensed with for supporting the transverse shaft 4 and support shaft 6. Further, the boom B and the implement tool cylinder S can be positioned to overlap the lock member 11 or laterally inward of the lock member 11 without being hindered by the lock member 11. As a result, the implement tool attachment device 2 may be applied to a loading work apparatus F including the right and left booms B with a smaller interval, and the right and left implement tool cylinders S with a smaller interval.

It should be noted that the best modes of the shapes of the respective components and the best modes of the positional relationships in the longitudinal direction, transverse direction and vertical direction among the respective components are as shown in FIGS. 1 to 6. Alternatively, however, those shapes and relationships should not be limited to the ones as shown and described in the above-described embodiment, but various modifications may be done to the components and arrangements, as well as combinations thereof.

For example, the implement tool G may be a fork, thumb implement tool or the like other than the bucket; and the boom B may be for a wheel loader, skid-steer loader, tractor loader backhoe or the like.

Further, a hydraulic cylinder may be mounted between the manual levers 14 of the right and left lock members 11 to oscillate the manual levers 14 for locking and unlocking operation.

What is claimed is:

1. A loading work apparatus comprising:

a pair of right and left booms;

an implement tool, the implement tool including an engaged member on a back surface thereof;

a transverse shaft;

a support shaft;

an attachment unit, the attachment unit being pivotally supported at a distal end of the boom associated therewith by the transverse shaft, the implement tool being removably attached to the attachment unit, the attachment unit including an engaging member engageable with the engaged member on the back surface of the implement tool;

a pair of right and left of lock members supported by the attachment unit for locking and unlocking engagement between the engaging member and the engaged member, the transverse shaft and the support shaft being arranged to bridge across each of the lock members;

a pair of right and left coupling members, each of the coupling members being provided on a back surface of the attachment unit for supporting the transverse shaft, each of the coupling members including a pair of right and left brackets standing upright from the back surface of the attachment unit on lateral opposite sides of the lock member associated therewith, the transverse shaft being supported at opposite ends thereof on respective lower portions of the right and left brackets, and the support shaft being supported at opposite ends thereof on respective intermediate portions of the right and left brackets; and a pair of right and left implement tool cylinders, each of the implement tool cylinders being connected to the implement tool associated therewith by the support shaft for rotating the implement tool about the transverse shaft.

2. The loading work apparatus according to claim 1, wherein the engaged member includes right and left upper engaged portions and right and left lower engaged portions provided on lateral opposite sides of the back surface of the implement tool; and wherein the attachment unit includes:

right and left upper engaging portions and right and left lower engaging portions engageable with the right and left upper engaged portions and right and left lower engaged portions of the implement tool, respectively;

a pair of right and left backing plates, each of the backing plates having the right and left brackets and the lock member; and a connecting rod for connecting the right and left backing plates to each other.

3. The loading work apparatus according to claim 1, wherein each of the lock members includes:

a lock pin vertically movably supported by the attachment tool associated therewith and projecting downward therefrom to be engaged with the engaged member associated therewith of the implement tool; and a manual lever pivotally supported by the attachment tool associated therewith for pushing and pulling the lock pin through a link; and wherein the lock pin is positioned laterally outward of each of the pair of right and left booms.

* * * * *